US008043993B2

(12) United States Patent
Roth et al.

(10) Patent No.: US 8,043,993 B2
(45) Date of Patent: Oct. 25, 2011

(54) TWO-SIDED THERMAL WRAP AROUND LABEL

(75) Inventors: Joseph D. Roth, Springboro, OH (US); Michael VanDemark, Springboro, OH (US)

(73) Assignee: NCR Corporation, Duluth, GA (US)

( * ) Notice: Subject to any disclaimer, the term of this patent is extended or adjusted under 35 U.S.C. 154(b) by 1124 days.

(21) Appl. No.: 11/559,515

(22) Filed: Nov. 14, 2006

(65) Prior Publication Data

US 2007/0213214 A1 Sep. 13, 2007

Related U.S. Application Data

(60) Provisional application No. 60/779,781, filed on Mar. 7, 2006, provisional application No. 60/779,782, filed on Mar. 7, 2006.

(51) Int. Cl.
*B41M 5/30* (2006.01)
*B41M 5/34* (2006.01)

(52) U.S. Cl. ..... 503/204; 503/226

(58) Field of Classification Search ..... None
See application file for complete search history.

(56) References Cited

U.S. PATENT DOCUMENTS

| | | | |
|---|---|---|---|
| 3,466,423 | A | 9/1969 | Janning |
| 3,518,406 | A | 6/1970 | Janning |
| 3,663,390 | A | 5/1972 | Fergason et al. |
| 3,947,854 | A | 3/1976 | Hansen et al. |
| 4,161,277 | A | 7/1979 | Steiner |
| 4,167,392 | A | 9/1979 | Defago |
| RE30,116 | E | 10/1979 | Maalouf |
| 4,309,255 | A | 1/1982 | Gendler et al. |
| 4,507,669 | A | 3/1985 | Sakamoto et al. |
| 4,631,596 | A | 12/1986 | Yaguchi |
| 4,708,500 | A | 11/1987 | Bangs et al. |
| 4,806,950 | A | 2/1989 | Sekine et al. |
| 4,853,256 | A | 8/1989 | Obringer et al. |
| 4,956,251 | A | 9/1990 | Washizu et al. |
| 4,965,166 | A | 10/1990 | Hosoi et al. |
| 4,987,118 | A | 1/1991 | Murata et al. |
| 5,055,373 | A | 10/1991 | Saeki et al. |
| 5,101,222 | A | 3/1992 | Hakkaku |
| 5,130,292 | A | 7/1992 | Ito et al. |
| 5,132,704 | A | 7/1992 | Nakagawa |
| 5,196,297 | A | 3/1993 | Dombrowski, Jr. et al. |
| 5,214,750 | A | 5/1993 | Minowa et al. |
| 5,219,821 | A | 6/1993 | Arbee et al. |
| 5,266,550 | A | 11/1993 | Asajima et al. |
| 5,272,127 | A | 12/1993 | Mandoh et al. |

(Continued)

FOREIGN PATENT DOCUMENTS

| | | |
|---|---|---|
| EP | 0947340 | 10/1999 |

(Continued)

OTHER PUBLICATIONS

JP Abstract, vol. 007,No. 063 (M-200), Mar. 16, 1983 & JP 57-208298 A (Ricoh KK), Dec. 21, 1982.

(Continued)

*Primary Examiner* — Bruce H Hess
(74) *Attorney, Agent, or Firm* — Charles Q. Maney

(57) ABSTRACT

In an embodiment, an image element having a thermally sensitive coating on at least a first side thereof is provided. The image element may further include an adhesive for attaching to an object such as a pharmaceutical container. Information about the object may be thermally printed on the image element.

8 Claims, 7 Drawing Sheets

U.S. PATENT DOCUMENTS 5,284,816 A 2/1994 Stephenson
5,319,392 A 6/1994 Durst et al.
5,339,099 A 8/1994 Nureki et al.
5,366,952 A * 11/1994 Granquist ..... 503/204
5,398,305 A 3/1995 Yawata et al.
5,428,714 A 6/1995 Yawata et al.
5,437,004 A 7/1995 Miyasaka et al.
5,476,698 A 12/1995 Denny
5,537,550 A 7/1996 Russell et al.
5,555,349 A 9/1996 Miyasaka et al.
5,584,590 A 12/1996 Ito et al.
5,585,321 A 12/1996 Breen et al.
5,594,653 A 1/1997 Akiyama et al.
5,629,259 A 5/1997 Akada et al.
5,639,169 A 6/1997 Aruga
5,667,303 A 9/1997 Arens et al.
5,677,722 A 10/1997 Park
5,686,159 A 11/1997 Langan
5,688,057 A 11/1997 Wright et al.
5,692,110 A 11/1997 Miyasaka et al.
5,707,925 A 1/1998 Akada et al.
5,710,094 A 1/1998 Minami et al.
5,727,135 A 3/1998 Webb
5,741,592 A 4/1998 Lewis et al.
5,754,213 A 5/1998 Whritenor
5,755,521 A 5/1998 Ito et al.
5,756,188 A 5/1998 Reiter et al.
5,763,356 A 6/1998 Ueno et al.
5,781,823 A 7/1998 Isobe et al.
5,789,340 A 8/1998 Brust et al.
5,792,725 A 8/1998 Simpson et al.
5,794,530 A 8/1998 Dobashi et al.
5,800,081 A 9/1998 Teradaira et al.
5,815,191 A 9/1998 Michielsen et al.
5,846,900 A 12/1998 Reiter et al.
5,876,836 A 3/1999 Imamura et al.
5,883,043 A 3/1999 Halbrook, Jr. et al.
5,886,725 A 3/1999 Miyadera et al.
5,918,910 A * 7/1999 Stillwagon et al. ..... 283/67
5,964,541 A 10/1999 Murison et al.
5,980,128 A 11/1999 Verlinden et al.
6,000,726 A 12/1999 Campbell
6,000,867 A 12/1999 Yoshii et al.
6,042,264 A 3/2000 Prusik et al.
6,095,414 A 8/2000 Long et al.
6,106,910 A 8/2000 Tan et al.
6,118,956 A 9/2000 Hirao
6,130,185 A 10/2000 Narita et al.
6,150,067 A 11/2000 Koike et al.
6,151,037 A 11/2000 Kaufman et al.
6,165,937 A 12/2000 Puckett et al.
6,197,722 B1 3/2001 Irving et al.
6,210,517 B1 4/2001 Eadara et al.
6,210,777 B1 4/2001 Vermeulen et al.
6,233,057 B1 5/2001 Ota
6,241,386 B1 6/2001 Limburg et al.
6,258,746 B1 7/2001 Mehta et al.
6,267,052 B1 7/2001 Hill et al.
6,350,072 B1 2/2002 Nunes et al.
6,388,692 B1 5/2002 Iwata et al.
6,416,154 B1 7/2002 Silverbrook
6,523,951 B2 2/2003 Takeya et al.
6,524,000 B1 2/2003 Roth
6,543,808 B1 4/2003 Mitchell, Jr. et al.
6,544,709 B1 4/2003 Wang et al.
6,544,925 B1 4/2003 Prusik et al.
6,562,755 B1 5/2003 Halbrook, Jr. et al.
6,663,304 B2 12/2003 Vives et al.
6,705,786 B2 3/2004 Trovinger
6,737,137 B2 5/2004 Franko, Sr. et al.
6,759,366 B2 7/2004 Beckerdite et al.
6,784,906 B2 8/2004 Long et al.
6,786,263 B1 9/2004 Fox, Jr. et al.
6,801,233 B2 10/2004 Bhatt et al.
6,803,344 B2 10/2004 Halbrook et al.
6,812,943 B1 11/2004 Day et al.
6,906,735 B2 6/2005 Bhatt et al.
6,962,449 B2 11/2005 Lermant et al.
6,962,763 B2 11/2005 Maskasky et al.
6,982,737 B2 1/2006 Elko et al.
7,192,904 B2 3/2007 Iwasaki et al.
7,514,262 B2 4/2009 Ribi
7,520,586 B2 4/2009 Itoh
7,589,752 B2 9/2009 Janning
7,623,145 B2 11/2009 Taguchi
7,671,878 B2 3/2010 Yamada et al.
7,760,370 B2 7/2010 Oki
2001/0034775 A1 10/2001 Minowa
2002/0122188 A1 9/2002 Elko et al.
2002/0124950 A1 9/2002 Klima
2003/0025779 A1 2/2003 Miyazaki
2003/0031861 A1 2/2003 Reiter et al.
2003/0112318 A1 6/2003 Long et al.
2003/0208560 A1 11/2003 Inoue et al.
2004/0046971 A1 3/2004 Lapstun et al.
2004/0084631 A1 5/2004 Spoonhower et al.
2004/0265542 A1 12/2004 Yanagisawa et al.
2005/0020387 A1 1/2005 Kennedy, III
2005/0031392 A1 2/2005 Yamamoto et al.
2005/0146739 A1 7/2005 Rayl et al.
2005/0146740 A1 7/2005 Fukuda
2005/0148467 A1 7/2005 Makitalo et al.
2005/0164881 A1 7/2005 Kenney et al.
2005/0271866 A1 12/2005 Lee
2006/0072001 A1 4/2006 Klein
2006/0289633 A1 12/2006 Moreland et al.
2007/0109349 A1 5/2007 Tanaka et al.
2007/0207926 A1 9/2007 Van Demark et al.
2007/0223022 A1 9/2007 Suzuki
2009/0184510 A1 7/2009 Frankel
2009/0195584 A1 8/2009 Itoh
2009/0225353 A1 9/2009 Ishibashi
2010/0225932 A1 9/2010 Kurose et al.

FOREIGN PATENT DOCUMENTS

GB 2 250 478 6/1992
JP 58008668 1/1983
JP 2001199095 7/2001

OTHER PUBLICATIONS

JP Abstract, vol. 007, No. 081 (M-105), Apr. 5, 1983 & JP 58-008668 A (Shinko Denki KK), Jan. 18, 1983.
JP Abstract, vol 015, No. 194 (M-1114), May 20, 1991 & JP 03-051149 A (Fujitsu General Ltd.), Mar. 5, 1991.
JP Abstract, vol. 2000, No. 24, May 11, 2001 & JP 2001-199095 A (Alps Electric Co. Ltd.), Jul. 24, 2001.
JP Abstract, vol. 1998, No. 08, Jun. 30, 1998 & JP 10-076713 A (Sony Corp.), Mar. 24, 1998.
JP Abstract, vol. 010, No. 151 (M-483), May 31, 1986, & JP 61-003765 A (Konishiroku Shashin Kogyo KK), Jan. 9, 1986.
JP Abstract, vol. 016, No. 041 (M-1206), Jan. 31, 1992 & JP 03-246091 A (Canon Inc.), Nov. 1, 1991.
Boca Systems Micro Plus 2S 2 Sided Printer product brochure which came to the attention of Applicant at a Chicago tradeshow during the summer of 2002.

* cited by examiner

TWO-SIDED THERMAL WRAP AROUND LABEL

RELATED APPLICATIONS

The present application claims priority to U.S. Provisional Patent Application Nos. 60/779,781 and 60/779,782, filed on Mar. 7, 2006, which are hereby incorporated by reference in their entirety for all purposes.

TECHNICAL FIELD

Various embodiments relate to direct thermal printing and, in an embodiment, but not by way of limitation, direct thermal printing labels for objects and containers.

BACKGROUND

Two, or dual-sided, direct thermal printing of documents such as transaction documents and receipts is described in U.S. Pat. Nos. 6,784,906 and 6,759,366. In dual-sided direct thermal printing, the printers are configured to allow concurrent printing on both sides of thermal media or image elements moving along a feed path through the printer. In such printers a direct thermal print head is disposed on each side of the media along the feed path. In operation each thermal print head faces an opposing platen across the media from the respective print head.

In direct thermal printing, a print head selectively applies heat to paper or other media comprising a substrate with a thermally sensitive coating. The coating changes color when heat is applied, by which "printing" is provided on the coated substrate. For dual-sided direct thermal printing, the sheet media substrate may be coated on both sides.

In various industries, there is a plethora of information that is either desired or required to accompany an object such as a product or container thereof. For example, in the pharmaceutical industry, there is a plethora of information that must be dispensed with pharmaceuticals when such pharmaceuticals are delivered to a patient. Some of that information is printed on a label that is attached directly to the container for the pharmaceutical. In many instances, the size of the container is dictated more by the amount of information on the label than by the volume of the pharmaceutical. Likewise, additional information desired or required to accompany an object, such as a pharmaceutical, may be separately printed from a label accompanying the object requiring additional resources, and increasing the potential for misdelivery.

SUMMARY

In an embodiment, an image element includes a first substrate having a front side and a back side. A first portion of the back side is for attachment to a product container, and a second portion of the back side comprises a surface for displaying information. The front side is for displaying information, the image element is for positioning on a product container, and the perimeter of the container is less than the length of the image element. Consequently, when positioned on the product container, the first portion of the back side substantially covers the perimeter of the product container, and the second portion of the back-side extends from the container and/or covers a portion of the front side of the image element. The image element may further include a second substrate for printing and provision of additional information.

DETAILED DESCRIPTION

By way of example, various embodiments of the invention are described in the material to follow with reference to the included drawings. Variations may be adopted.

Background material applicable to direct thermal printing and related media production and their common features are generally described in U.S. Pat. No. 6,803,344, the disclosure of which is hereby incorporated by reference herein.

Figure 1:
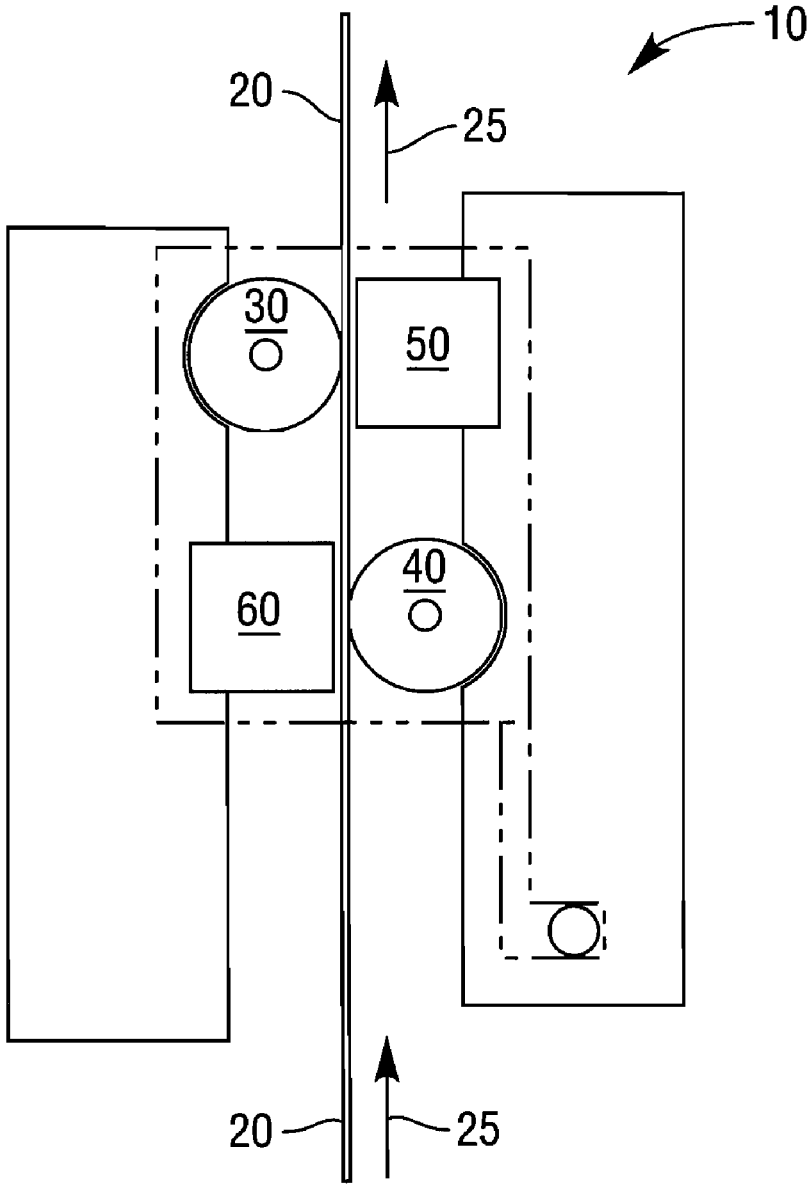
FIG. 1 illustrates a schematic of an example embodiment of a dual-sided imaging direct thermal printer.

FIG. 1 shows a schematic of a dual-sided imaging direct thermal printer 10 useable for, inter alia, dual-sided, single pass printing of transaction receipts, tickets, labels, or other documents and image elements at time of issue. The printer 10 operates on print media 20 which is double-sided thermal paper, e.g., comprising a cellulose or polymer-based substrate coated on each side with heat sensitive dyes as described in U.S. Pat. Nos. 6,784,906 and 6,759,366. Multi-color printing capability can be provided on both sides of the document by using two or more dyes with sensitivity to different temperatures on a side where multi-color printing is desired. Substrates and heat sensitive color changing coatings for direct thermal printing media are generally well known in the art. Dual-sided direct thermal printing can be facilitated by a media 20 which includes dyes sensitive to different temperatures on opposite sides of the media 20, and/or by use of thermally resistant substrates to inhibit thermal printing on one side of the media 20 from affecting the coloration on the opposite side of the media 20.

As shown in FIG. 1, the printer 10 has rotating platens 30 and 40 and opposing thermal print heads 50 and 60 on opposite sides of the print media or image element 20. Dual-sided direct thermal printing of the media 20 occurs in a single pass at the time of the transaction or when a document is issued. The media 20 can be cut or severed using, for example, an electromechanical knife (not shown) to provide an individual document, typically once printing is completed.

Exemplary media 20 comprises an opaque substrate and a thermally sensitive coating on each side for general two-sided direct thermal printing applications. The substrate or base sheet can comprise those materials used in conventional direct thermal printing applications, including materials derived from synthetic and/or natural fibers such as cellulose (natural) fibers, e.g., opaque paper, and polyester (synthetic) fibers. Substrates may also include extruded plastics and/or films using materials such as Kapton, polyethylene and polyester polymers. Calendering may be provided to produce a smoothness of 75 Bekk or greater on each side of the media 20 to improve the thermal imaging. A subcoat or base coat, e.g., predominantly of calcium carbonate or clay, and binder material, e.g. a latex-based binder, may be provided on paper substrates to enhance smoothness of finish and the quality of direct thermal printing and/or to protect the thermally sensitive coating from chemicals inherent to the substrate, among other reasons.

Without a subcoat, a typical smoothness achieved by calendaring of base paper before applying thermally sensitive coatings would be in the range of 75-150 Bekk. With a subcoat and calendaring a finished smoothness of 250 Bekk or greater is typical. To give higher quality thermal imaging characteristics, e.g., for bar code printing, a minimum finished smoothness of 300 Bekk should be used. Where used, a subcoat weight of about 1-10 lbs/3300SFR (square foot ream) per side for one or both sides, preferably 2-5 lbs/3300SFR per side for one or both sides, is generally typical.

Calendering to provide smoothness of the sides of the media 20 can comprise, e.g., on-line or off-line soft or soft nip calendaring or supercalendering in one or more pass operations. Supercalendering, typically performed off-line from a paper production line, may be performed using a stack of alternating chilled cast iron and fiber-covered rolls. The fiber-covered rolls may for example be covered with highly compressed paper for processing uncoated papers, or with highly compressed cotton for processing papers with coatings. In a soft calendar, a composite-covered crown roll can run against a heated metal roll, e.g., in an in-line process, to produce a desired sheet surface finish and gloss. To calendar both sides of the media 20 in one pass, two or more roll stacks may be used.

The thermally sensitive coatings are preferably of the dye-developing type particularly when used with opaque paper substrates for the media 20, e.g., for two-sided direct thermal printing applications. Such coatings would typically comprise a developer, an optional sensitizer and color former or dye, e.g., leuco-dye, and undergo a color change upon transfer of heat. Different thermally sensitive coatings, e.g., of the dye-developing type or the dye-sublimation type, can be used and may vary with the substrate material, e.g., plastic substrate materials. The dye-developing type thermally sensitive coating, e.g., overlying the subcoat where used, would generally have a weight of about 1-8 lbs/3300SFR, or preferably about 1-3 lbs/3300SFR. Without a subcoat, the weight of a thermally sensitive layer will typically be greater.

A subcoat can be used on one side or both sides and the degree of calendering or finished smoothness can be the same or different on each side of the media 20, according to considerations of cost and the requirements of particular applications involved. For example, a higher quality of printing may be required for one side such as where printing of a bar code may be required. Such an application would normally require use of a subcoat and calendaring to a finished smoothness 300 Bekk or greater on the bar code print side of the media 20. The same finish or a less expensive finish might be used for the other side of the media 20. Similarly the character, chemical composition, thermal sensitivity and cost of the thermally sensitive coating could be the same or different on each of the two sides, e.g., a sensitizer may be used on one or both sides of the media 20 depending upon application. Different chemistries on the two sides of the media 20 can be employed to provide different environmental compatibilities or properties or other desired product characteristics such as imaging color.

The subcoat where used could be the same on each side or have a different composition or weight on each side of the media 20, again depending upon cost and application considerations. For example, if there is to be any ink jet printing as well as direct thermal printing on one side a calcium carbonate subcoat may be preferred.

The thermally sensitive coatings on each side of the media 20 can provide single color printing on each side of the media 20, where the print colors are the same or different on each side of the media 20. Alternatively, multiple color direct thermal printing may be implemented on one side or both sides, using multiple thermally sensitive coatings or multiple thermally sensitive layers within a coating, e.g., as taught in U.S. Pat. No. 6,906,735, or using multiple dyes within a coating layer, where the available print color choices are the same or different on each side of the media 20.

In some applications it may be desirable to provide the thermally sensitive coating on one or both sides of the media 20 in the form of a spot, strip or pattern coating or to provide for a spot, strip or pattern of special or higher cost finish on one or both sides. For example, to provide for printing of a bar code at a particular location on the media 20 the requisite smoothness of finish and thermally sensitive coating could be limited to that location. Further, repetitive sense marks could be applied to one or more locations of one or both sides of the media 20 to allow a location for printing of particular information, such as a bar code, to be identified during the printing process. For some applications the sense marks could have different repeat lengths on opposite sides of the media 20, e.g., to allow for different intended print sizes or areas. In a further embodiment, sense marks may be used to allow location of or within a removable portion of the media 20, such as a label portion, to be determined in advance of printing desired information on one or both sides thereof. Regardless of the application, one or more sensors (not shown) associated with the printer 10 may be used to identify the sense marks and trigger printing of the appropriate information in the appropriate region or location.

For image protection and environmental durability, a top coat can be applied over the thermally sensitive coating on one or both sides of the media 20. Where used, the topcoat could comprise a spot, strip or pattern coating, e.g., for the added protection of particular printed information such as a bar code. Repetitive sense marks could be applied to the media 20 to help identify the particular topcoat spot, strip or pattern locations. The topcoat may include any suitable components that serve to protect or enhance certain performance properties of the thermally sensitive or functional layer and may include water, polymers, monomers, UV absorbers, scratch inhibitors, smear inhibitors and the like.

The media 20 may be provided with one or more areas pre-printed by ink, thermal printing or other non-thermal printing on at least one side of the media 20, e.g., for security features, pre-printing of standard terms or advertising, depending on application requirements. The pre-printing could also provide a colored background area affecting the color of a final image. For example, yellow ink over a red image thermal paper could be used to provide an orange final image color.

Two-sided direct thermal printing media 20 can comprise multi-color capability on one or both sides of the media, for printing in multiple colors on one or both sides of the media. This can provide for custom, full color printing of variable information on one or both side of the media, including full color photographic quality images. Such full color printing can be accomplished with crystalline dyes that transition from clear to colored in response to input from a thermal print head.

As previously described, a thermally sensitive or functional coating can include dyes such as leuco dyes necessary for forming an image. At least three dyes must be present to make a full color image (e.g., cyan, magenta, and yellow). These dyes can be present as a mixture of crystalline dyes that change from clear to colored in response to application of heat. The dyes can be mixed with appropriate binders, additives, and solvents as required to allow ease of coating and proper functioning of finished products.

The various sub, functional and top coatings on the one or both sides of a thermal media 20 can be applied to the substrate by any suitable means such as flooding and metering, and subsequent drying. Alternately, spraying may be used instead of flooding and metering. Such as dual-sided thermal image element or media 20 can be manufactured with any suitable process or apparatus, such as a conventional in-line paper coating machines. Likewise, a dual-sided thermal image element or media 20 is preferably printed in a suitable dual-sided imaging direct thermal printer as described in U.S. Pat. No. 6,759,366.

A dual-sided thermal image element or media 20 may be produced in the form of an individual tag or label, or comprise a dual-sided thermal media 20 having nested tags or labels. For example, very small tags or labels may be produced having a size of approximately ½" to 2" in width, 1" to 4" in length, and a thickness of 3 mil to 35 mil. The substrate for such tags or labels may either be cellulosic or polymeric, and generally opaque. Protective layers, if present, generally provide some environmental resistance.

A two-sided thermal paper/nested label combination is especially useful when used in form-label combinations. The two-sided nature of the combination allows the front and back of the media to be imaged. Removable portions included on the front and/or back side of such media may then be printed on and taken from the media. Such portions may include suitable release materials, such as UV cured silicone, which may be applied in a spot or patterned arrangement. Beneficial adhesives include hot melt, water based, and UV cured adhesives. Where hot melt adhesives are used, care must be taken to prevent unwanted imaging the thermal media. Premature imaging during the application of hot melt adhesive may be attended, e.g., by using a chilled vacuum roller, a chill roller followed by a vacuum roller, etc.

A two-sided thermal form-label combination has all of the advantages of two-sided thermal image elements such as being imagable in a simple, robust printer resulting in reduced service calls, fewer jams, and requiring only one consumable (e.g., thermally imagable media). Two-sided thermal printing may additionally provide for increased print speeds and reduced paper consumption as compared to one-sided thermal setups.

Example applications for a two-sided thermal form-label include pharmacy script and shipping label/packing lists, among others.

An embodiment involves a two-sided thermal product label, and in a particular embodiment, a two-sided thermal pharmacy label. These and related embodiments address the situation wherein the amount of information that is required or desired for objects such as products or their containers, e.g., pill bottles and/or other pharmaceutical containers, is extensive. This situation requires, for example, larger and larger pill bottle labels, which in turn requires larger pill bottles. In many situations, the pill bottles are already much larger than required to contain the pills. It is desirable to use smaller pill bottles as they are more cost efficient, easier to handle and the like. Therefore, these embodiments allow for variably printed labels with extended printable areas on both sides of a label. Printing on both sides of a label provides opportunity to minimize the amount of label required for a given amount of information.

Figure 2A:
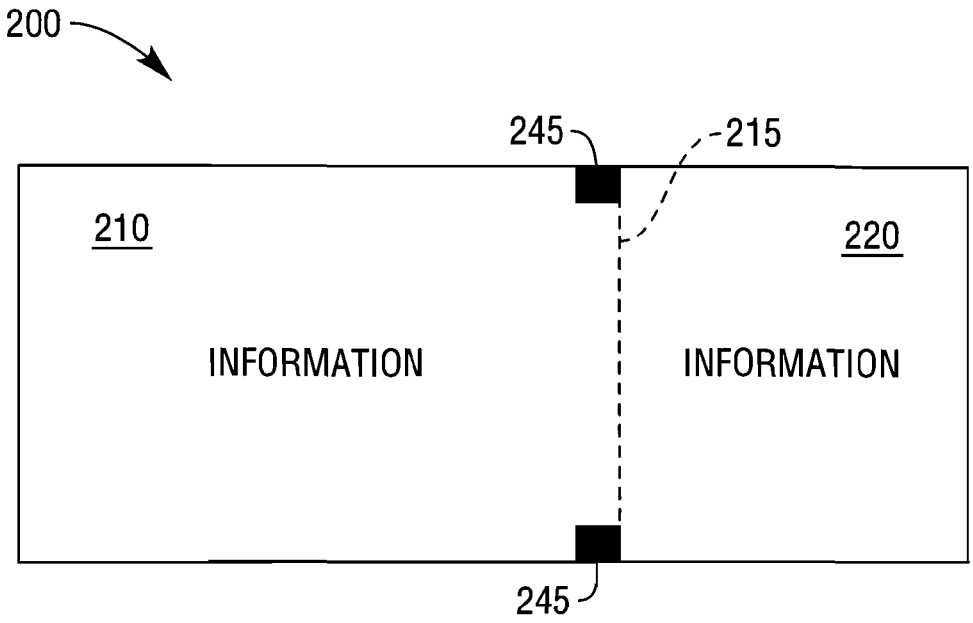
FIG. 2A illustrates an example embodiment of a first side of an image element in the form of a label.
Figure 2B:
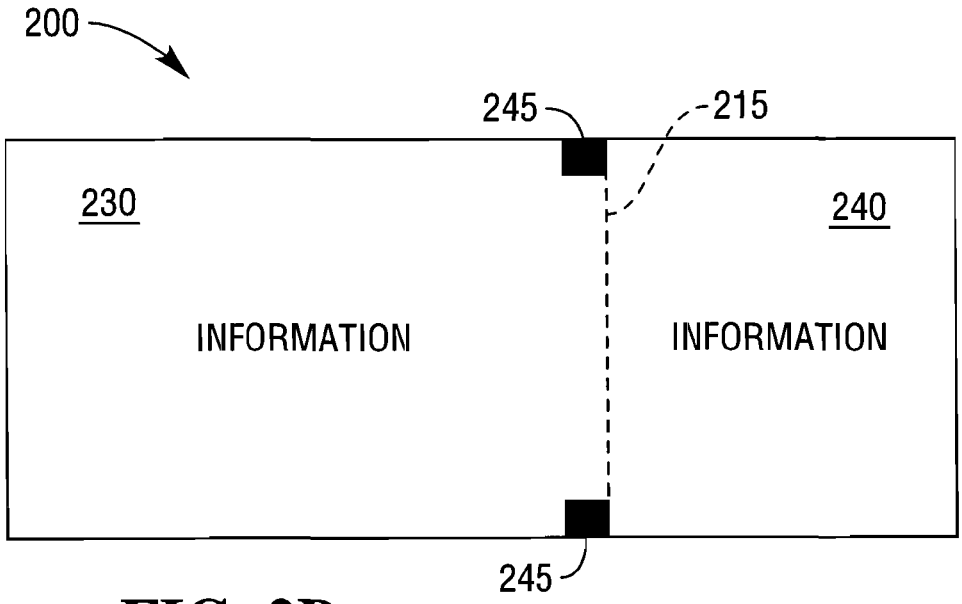
FIG. 2B illustrates an example embodiment of a second side of the label of FIG. 2A.

In one embodiment, the length of a label is longer than the circumference (or perimeter) of a container such as a bottle to which the label is attached. An example of such a label is illustrated in FIGS. 2A and 2B. FIG. 2A represents a front side of a label 200, and FIG. 2B represents a back side of the label 200. Referring first to FIG. 2B, the back side of the label 200 includes a first section 230 and a second section 240. The two sections 230 and 240 are separated by an imaginary line 215. An adhesive or other securing means is placed on the section 230, and the label 200 is then wrapped around, and attached to, a product container (not shown in FIGS. 2A and 2B). The length of section 230 is approximately equal to the circumference (or perimeter) of the product container, although more or less surface coverage may be provided for. The section 240 may have product or other information printed thereon. In one embodiment, the section 230 may also have information printed on it such that when the label 200 is attached to a transparent or semi-transparent container, such as a container for a pharmaceutical, the information can be viewed by peering into the inside, or looking through from the outside, of the container.

FIG. 2A illustrates the front side of the label 200 and includes a first section 210 and a second section 220 separated by the imaginary line 215. In some embodiments, the imaginary line 215 that separates the sections 210 and 220 of the front side of the label 200, and as shown in FIG. 2B sections 230 and 240 of the back side of the label 200, may comprise one or more perforations, cuts, detents, depressions and the like to allow the portion of the label 200 comprising the sections 220 and 240 to be removed from the label 200. Likewise, as illustrated in FIGS. 2A and 2B, the sections 210 and 220 of the front side of the label 200, and the sections 230 and 240 of the back side of the label 200 may be separated by one or more sense marks 245 which, as previously described, may be used, inter alia, to confine printing of information by a printer 10 to one or more desired sections, or regions thereof.

As further illustrated in FIGS. 2A and 2B, the section 210 is approximately equal in length to the section 230, and the section 220 is approximately equal in length to the section 240. As for sections 230 and 240, both section 210 and 220 may have product or other information printed thereon. Similarly, the length of section 210 is approximately equal to the circumference (or perimeter) of the product container, although as for the section 230 more or less surface coverage may be provided for.

Figure 3:
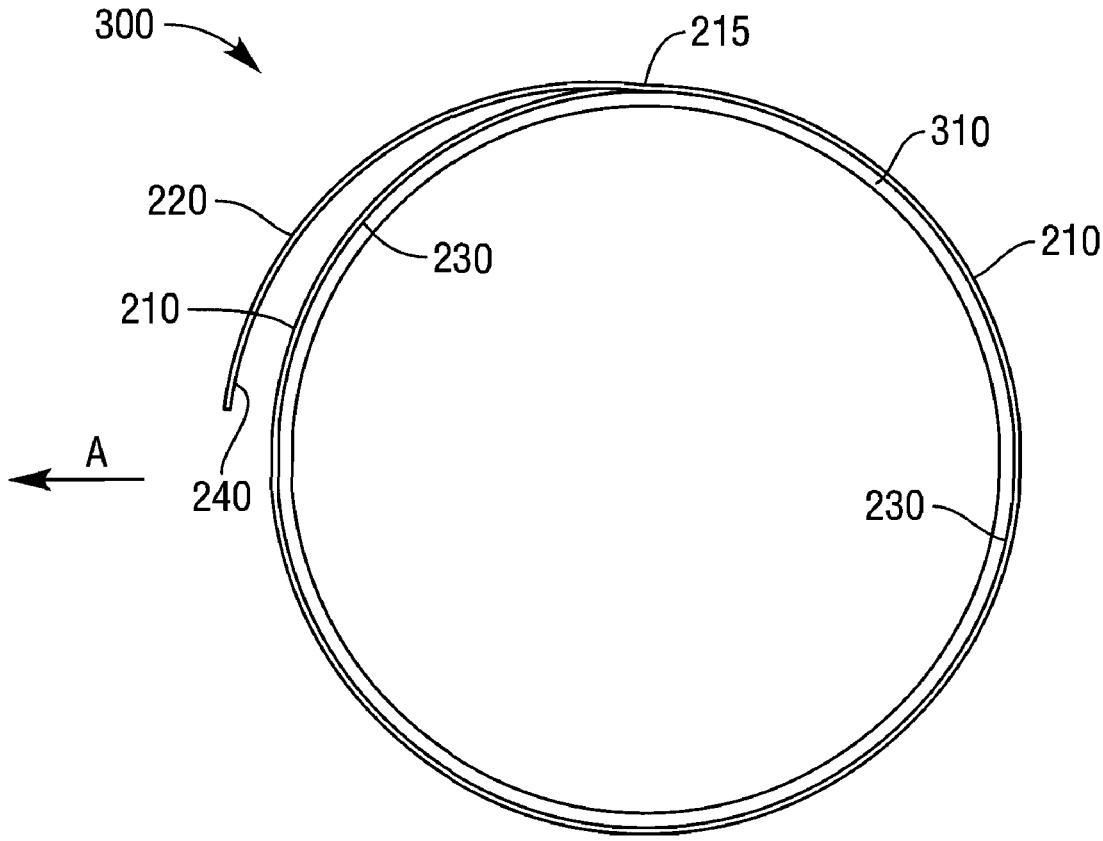
FIG. 3 illustrates an example embodiment of a label that is wrapped around an object in the form of a container.

FIG. 3 illustrates a system 300 comprising a label 200 as it may appear when placed on an object in the form of a circular container 310. Other objects and shapes thereof are, of course, possible. FIG. 3 is from the viewpoint of looking down onto the top of the container 310. Referring to FIG. 3, the label 200 is applied to the container 310 such that the section 230 will be in contact with, and attached to, the container 310 via, for example, an included adhesive layer. As shown in FIG. 3, the portion of the label 200 comprising the sections 210 and 230 substantially wraps around the circumference of the container 310, and the portion of the label 200 comprising the sections 220 and 240 substantially extends beyond the periphery of the container 310. As a result, and as further shown in FIG. 3, the portion of the label 200 comprising the sections 220 and 240 may wrap around and/or otherwise lay on top of the portion of the label comprising the sections 210 and 230. By moving the portion of the label 200 comprising the sections 220 and 240 away from the container, i.e., in the direction of arrow A in FIG. 3, the section 210 of the label 200 that was covered is exposed and the information on it can be read. Similarly, when the portion of the label 200 comprising the sections 220 and 240 is moved in the direction of arrow A, the information on the section 240 is also exposed. Further, if some or all of the container on which the label 200 is attached is clear or translucent, information printed on the section 230 may be read through the container, either from the outside looking in or from the inside looking out.

Thus, the label 200 may wrap on top of itself when applied to a container 310 such as a pharmaceutical or pill bottle. The label 200 can be applied to the container 310 such as a bottle via an adhesive, tape, or other attachment means. Further, some or all of the front side of the label, such as the section 210, may be covered with a release coating such as silicone to, inter alia, make it easy to unwrap or lift the section 240 of the label 200 from the section 210. By contrast, the section 230 of the label 200 is affixed to and does not easily release from the container 310. In this way an end user can unwrap or lift a portion of the label to reveal additional information.

The wrap around portion 220 and 240 of the label 200 may also be used to hide or otherwise obscure from ready view certain information printed on the portion 240 and/or 210 of the label 200 to, inter alia, protect privacy, mitigate fraud and the like. In such case, a second adhesive portion or stripe (e.g., adhesive stripe 255 of FIG. 4B), with or without a proximate release agent, may be used to removably or releasably secure the section 240 to a mating portion of the section 210.

Additionally, a portion of the label 200 extending beyond the container 310 may be removable from the container 310 through the use of, inter alia, one or more cuts, tears, depressions, stress concentrators and the like, such as perforations at a line 215 of a label 200 as shown in FIGS. 2A and 2B. The removable portion of the label 200, which may comprise some or all of the portion represented by the sections 220 and 240, may then be separately stored or used such as for a redeemable coupon, an advertisement, a transaction receipt, and the like.

Figure 4A:
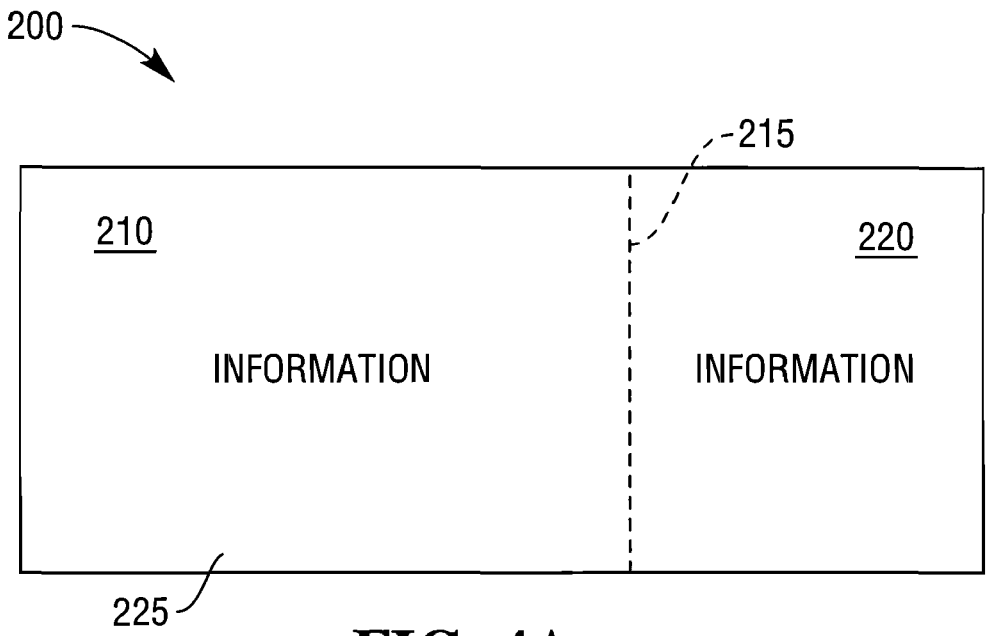
FIG. 4A illustrates another example embodiment of a first side of an image element in the form of a label.
Figure 4B:
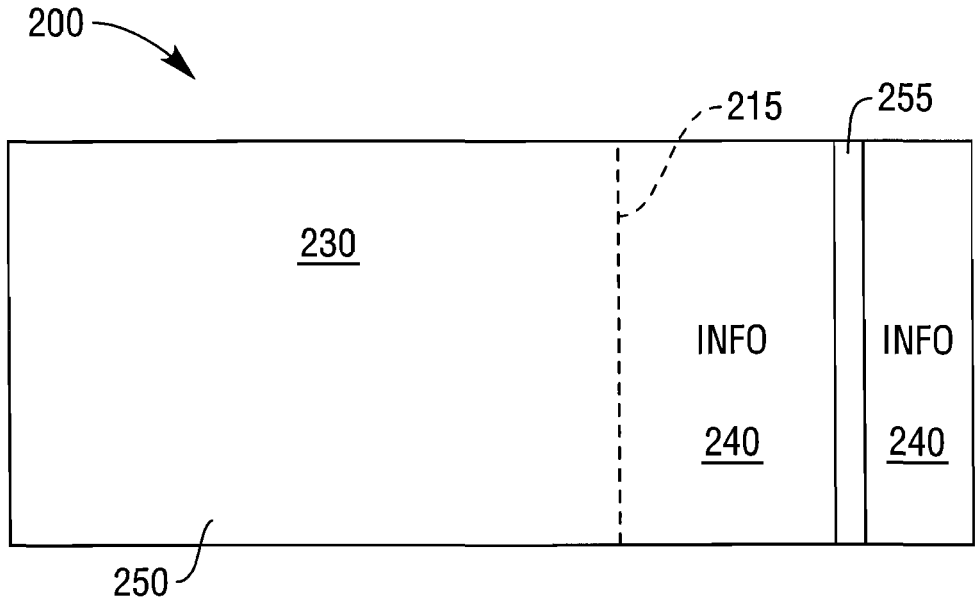
FIG. 4B illustrates an example embodiment of a second side of the label of FIG. 4A.

FIGS. 4A and 4B illustrate another embodiment of a wrap-around label 200 for use on, inter alia, objects and containers such as pharmaceutical bottles. As shown in FIG. 4A the section 210 of the front side of the label 200 includes a release coating 225, such as silicone. It should be noted that in other embodiments the release coating 225 may additionally or alternately be applied to other sections of the label 200, such as the section 220, or portions thereof. The back side of the label 200, illustrated in FIG. 4B, which includes sections 230 and 240, contains two patches of adhesive 250 and 255. The larger patch of adhesive 250 is approximately equal in size to the section 230, which section is designed to substantially traverse the circumference or perimeter of a container or other object upon which the label 200 is to be placed. The primary function of the adhesive patch 250 is to secure the label 200 to the container. It should be noted that in other embodiments the adhesive patch 250 may be cover less than all of the section 230. The smaller patch of adhesive 255, which covers a portion of the section 240 on the back side of the label 200, is designed to form a temporary bond with the silicone or other release coating 225 on the section 210 of the front side of the label 200 when the label is affixed to and wrapped around the container. This temporary bond secures the portion of the label 200 comprising the section 240 to the bottle when it is not being used. The smaller adhesive patch 255 and silicone coating 225 on the front side of the label 200 permits the wrapped label to be readily lifted when needed (e.g., to read the information printed on the section 240 and the portion of the section 210 covered by it) and then re-secured to the container (e.g., to hide some or all of the information printed on the section 240 and the portion of the section 210 covered by it). Size and location of the smaller adhesive patch 255 may be varied to control adhesion of, and area for printing of product information on the section 240. Further, different adhesives 250 and 255 may be used to, for example, provide for more or less permanence or removability of adhesion, with or without use of a release coating 225.

Figure 5A:
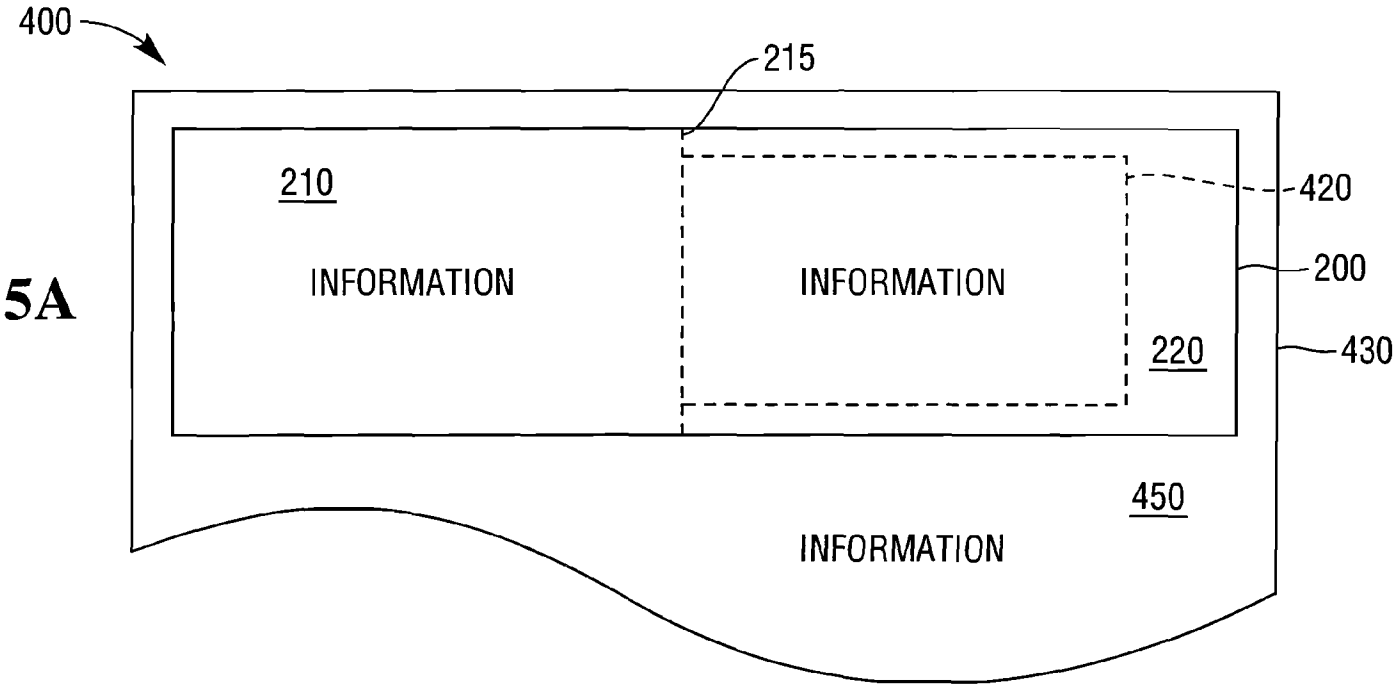
FIG. 5A illustrates a cross sectional view of an example embodiment of a form-label combination.
Figure 5B:
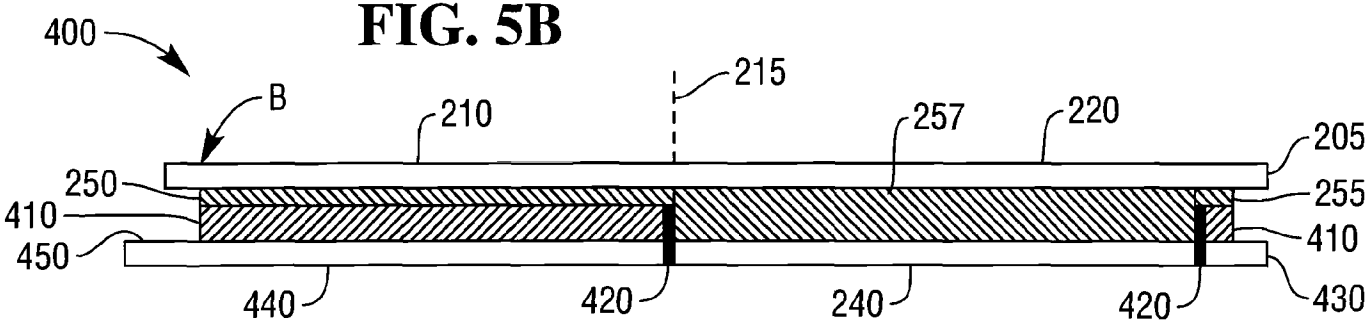
FIG. 5B illustrates a top view of the form-label combination of FIG. 5A.

FIGS. 5A and 5B illustrate another embodiment which may be referred to as a form-label combination 400. Form-label combination 400 may be manufactured as a roll of form-labels, a fan-fold of form-labels, as individual (single) form-labels, and the like. A single form-label combination is illustrated in FIGS. 5A and 5B for ease of explanation. As illustrated in FIG. 5A, the form-label combination 400 includes a label 200, a base sheet 430, and a die cut 420 on a back side of the base sheet 430.

As illustrated in FIG. 5B, the form-label combination 400 illustrated in FIG. 5A further includes a top sheet 205, adhesive sections 250, 255 and 257, and a silicone layer 410. As illustrated in FIG. 5B, the top sheet 205, the adhesive sections 250, 255 and 257, and the portion of the base sheet 430 bounded by the die cut 420 and identified as the section 240 comprise an embodiment of a label 200 as previously illustrated in, for example, FIGS. 2A, 2B, 3, 4A and 4B.

FIGS. 5A and 5B further illustrate portions of the form-label 400 upon which printing, including thermal printing, of information may be effected. These sections include the sections 210 and 220, separated by imaginary line 215 on the front side of the top sheet 205, the section 240 bounded by the die cut 420 on the back side of the base sheet 430, the section 440 comprising the balance of the back side of the base sheet 430, and the section 450 comprising the portions of the front side of the base sheet 430 not covered by the label 200. Likewise, in other embodiments, printing, including thermal printing, of information may occur on additional portions of the form-label 400 including, inter alia, a back side of the top sheet 205 under the section 210, and a front side of the base sheet 430 proximate to the release layer 410.

In order to effect printing, in one embodiment, the top sheet 205 of the form-label 400 comprises single sided thermal media having a thermally sensitive coating on portions of the top sheet 205 comprising the sections 210 and 220, and the base sheet 430 comprises a double sided thermal media having thermally sensitive coatings on both a front and back side thereof, including the sections 240, 440 and 450, although other embodiments are also possible.

Printing, including thermal printing, of the base sheet 430 allows for the provision of information beyond that which may be possible or practical to provide on the label 200, including the sections 210, 220 and 240 thereof. Such information may be independent, or relate to and augment the information printed on a portion of the form-label 400 comprising the label 200 including, but not limited to, contract information, transaction (receipt) information, warranty information, rebate information, advertisements, coupons, and the like. In the context of a pharmaceutical application, the label 200 may include information which would ordinarily accompany a container of a pharmaceutical such as patient and drug name, dosage, administering information, and the like, while remaining portions of the base sheet 430 may include detailed drug information, interaction information, transaction (receipt) information, and the like, as desired or required to accompany a distribution of the pharmaceutical.

When it is desired to remove the label 200 from the form-label combination 400 of FIGS. 5A and 5B, the label 200 is grasped and pulled away from the base sheet 430 beginning at, for example, point B in FIG. 5B. As the label 200 is pulled away from the base sheet 430, the adhesive section 250 separates from the silicone release layer 410 while the adhesive section 250 remains attached to the top sheet 205 of the label 200. When the leading edge of the die cut 420 is reached, the adhesive section 257 between the top sheet 205 and the base sheet 430 pulls the section 240 of the base sheet 430 along with the top sheet 205, thereby removing this portion from the remainder of the base sheet. When the trailing edge of the die cut 420 is reached, the portion 240 of the base sheet that is attached to and that is being removed with the label 200 separates from the rest of the base sheet 430. The portion 240 of the base sheet 430 that is removed with the top sheet 205 as the label 200 is removed from the form-label combination 400 is the portion 240 that will, for example, extend beyond and wrap around the portion 210 after the label 200 is attached to a container, as previously illustrated in FIG. 3.

It should be noted that adhesive sections 250, 255 and 257 may comprise the same or different adhesives, depending on the application. For example, adhesive sections 250 and 255 may comprise readily releasable adhesives for use with or without a release layer 410 while the adhesive layer 257 may comprise a permanent adhesive for permanent attachment of the section 240 of the base sheet 430 to the section 220 of the top sheet 205. Other adhesives and application locations/coverage are possible.

Figure 6A:
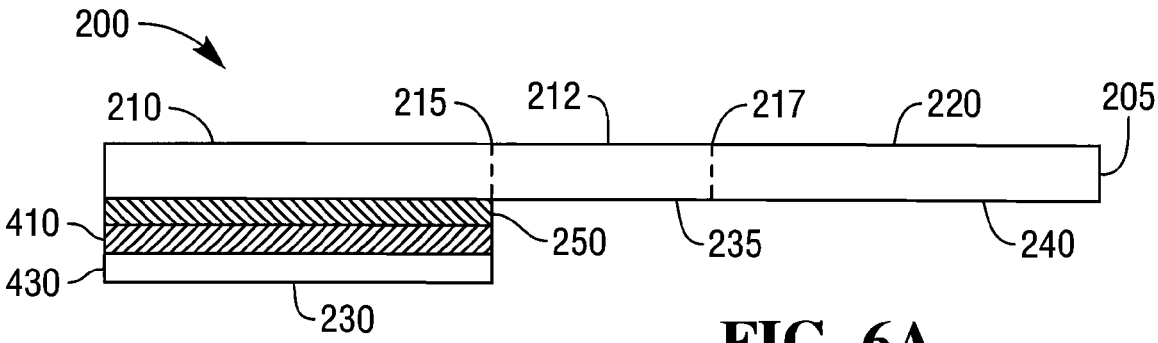
FIG. 6A illustrates a cross sectional view of another example embodiment of an image element in the form of a label.
Figure 6B:
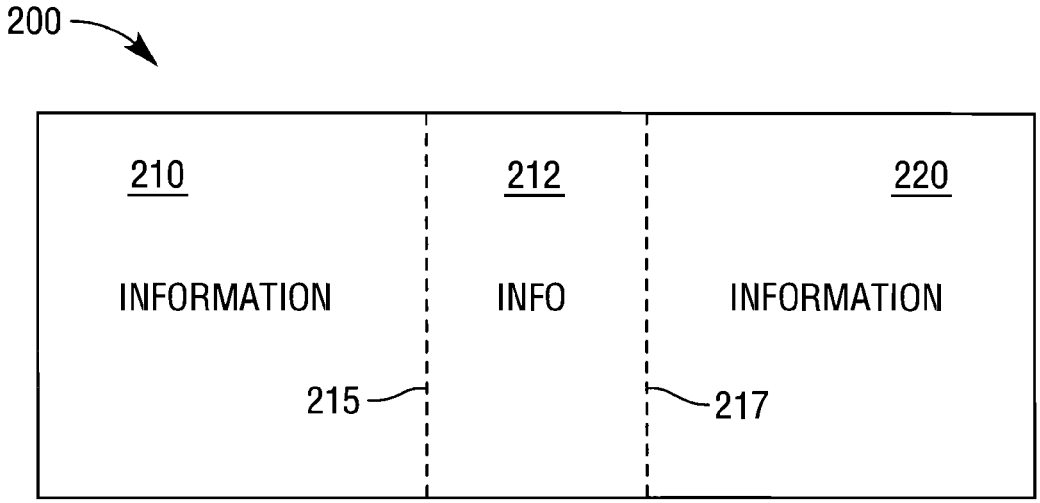
FIG. 6B illustrates a view of a first (top) side of the label of FIG. 6A.
Figure 6C:
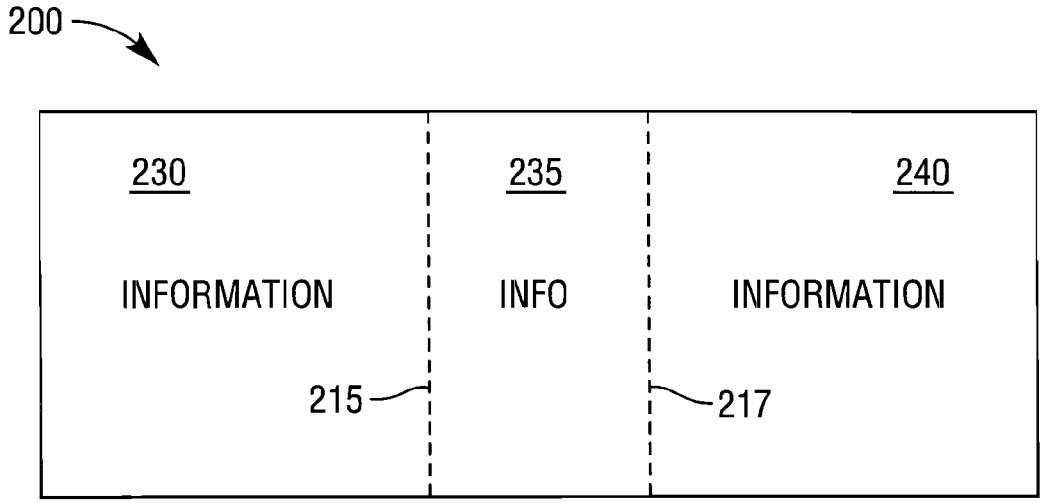
FIG. 6C illustrates a view of a second (bottom) side of the label of FIG. 6A.

In a further embodiment, illustrated in FIGS. 6A, 6B and 6C, a label 200 comprises a top sheet 205, a base sheet 430, an adhesive 250 and a release layer 410. In this embodiment, the top sheet 205 may have a thermally sensitive coating on both sides to allow for custom imaging of, inter alia, sections 210, 212, 220, 235 and 240. while the base sheet 430 may have a thermally sensitive coating on one side thereof to allow for thermal imaging of the section 230, although other embodiments are possible, including provision of a thermally sensitive coating on a back side of the base sheet 430, opposite the section 230.

As show in FIGS. 6B and 6C, some or all of the label 200, including the portions 210, 220, 235 and 240, may be printed with information such as object, container and/or other information. Likewise, some or all of the section 230 of the base sheet 430 may be printed with information such as object, container and/or other information. In one embodiment, the printed portions of the sections 210, 220, 235 and 240 of the label top sheet 205 include purchased product information, and the printed portion of the section 230 of the base sheet 430 included transaction (receipt) information. In a further embodiment, the sections 210, 220, 235 and 240 include product and/or transaction information, and the section 230 includes coupon or advertisement information. Likewise, in another embodiment, the sections 210, 220, 235 and 240 may include object storage information, and the section 230 may include claim ticket information for identification and retrieval of a stored item with which the label 200 is associated.

As applied to an object, the label 200 of FIGS. 6A, 6B and 6C may be folded about the imaginary lines 215 and 217 such that the region 235 of the label 200 surrounds a portion of the object, such as a handle, and the adhesive 250 contacts and is adhered to the section 240. Such a label may find application in, for example, a baggage handling system where the top sheet 205 becomes the baggage tag, and the base sheet 430 becomes a claim ticket.

It should be noted that in further embodiments of a label 200 as illustrated in FIGS. 6A, 6B and 6C, including but not limited to variations for the above described baggage handling application, the base sheet 430 and the adhesive and release layers 250 and 410, respectively, may cover an area equal to more or less than the area of the top sheet 205, including covering a portion equal to all of the back side of the top sheet 205. In such case the base sheet 430 may have a thermally sensitive coating on both sides and the top sheet 205 may have a thermally sensitive coating on only the top side thereof.

Further, depending on the application, some or all of the information printed on a label 200 may be thermally printed using a single or dual-sided thermal printer such as the thermal printer 10 of FIG. 1. Likewise, some or all of such information may be printed using lithographic, flexographic, relief, gravure, or any other suitable printing method. It should be noted that where thermal printing is performed, an appropriate portion of a label 200 may be coated with one or more thermally sensitive inks, which may include one or more leuco dyes, developers, and sensitizers and may vary with location (e.g., section or portion thereof) on the label 200.

In general, information printed on a label 200 may include information related to a product or item with which the label 200 is associated or on which the label 200 is attached. This may include product or item name or other identification, ingredients, specification, size, weight, storage and handling, cost, and the like. Further, information related to a purchase or other transaction involving the product or item, including typical receipt information (e.g., store name and/or logo, date, time, product name and/or code, price, tax, payment means, and the like), may also be included on the label 200, or a portion thereof. Further, the information that is provided may vary depending on the application.

For example, in a pharmaceutical application, provided information may include, inter alia, (1) patient information including name, address, phone number and/or photo, (2) insurance information including carrier name, group number, and the like, (3) cost and/or payment information, (4) drug and/or prescription information including dosage information, administering information, adverse and/or other interaction information and the like, (5) pharmacy information including name, address, logo, and the like, (6) warning information, (7) advertisements, (8) loyalty information, and the like. Likewise, in a baggage tag application, such information may include, inter alia, (1) baggage information such as a size, weight, color, and/or other distinguishing characteristic of a bag, (2) passenger information including name, address, phone number, and/or photo, (3) transportation means information-including ticket number, departure and destination locations, and/or carrier name, and the like. Other applications and types of information provided are possible.

Where photos are provided, such photo may be contemporaneously recorded and printed using, for example, a digital camera attached to or associated with a computer or terminal to which a thermal printer, such as the printer 10 in FIG. 1, is connected for printing on the label 200. Likewise, such photo may comprise a stored photo associated with a customer loyalty program, or governmental agency (e.g., driver's license, passport, and the like) retrievable by a computer to which the printer 10 is connected.

Figure 7A:
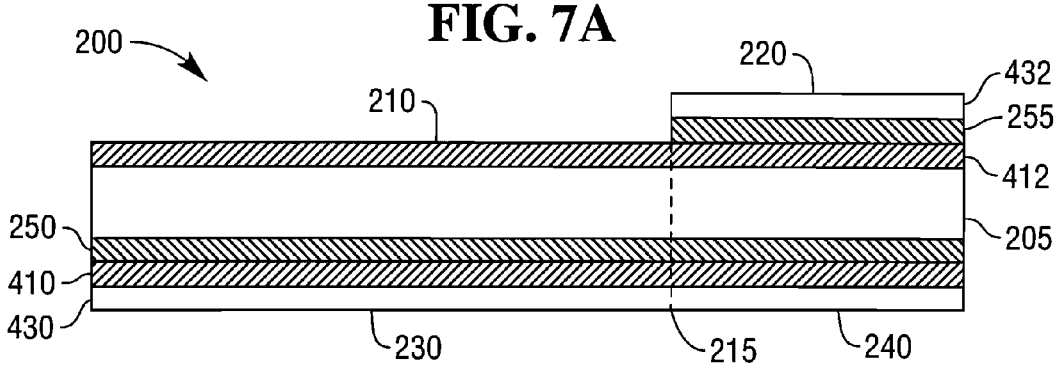
FIG. 7A illustrates a cross sectional view of another example embodiment of an image element in the form of a label.
Figure 7B:
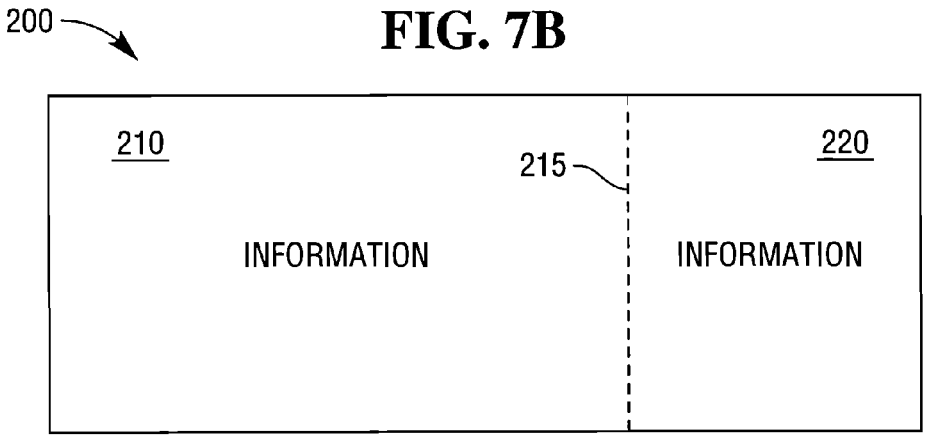
FIG. 7B illustrates a view of a first (top) side of the label of FIG. 7A.
Figure 7C:
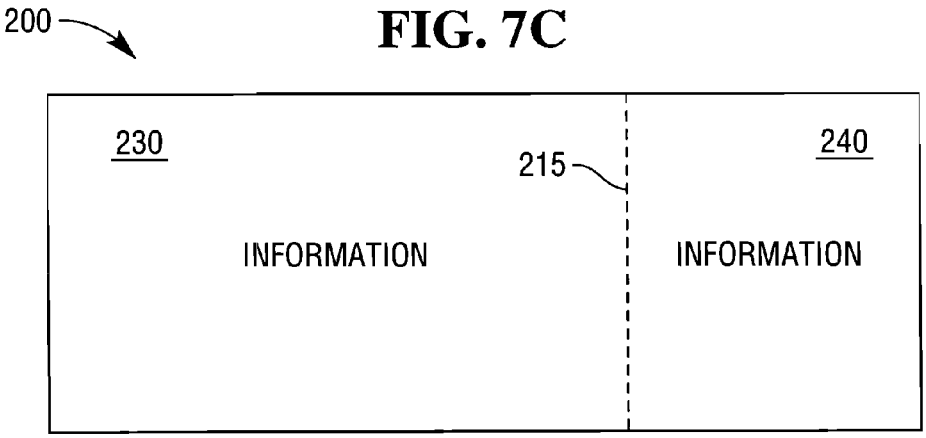
FIG. 7C illustrates a view of a second (bottom) side of the label of FIG. 7A.

FIGS. 7A, 7B and 7C illustrate another embodiment of a label 200. FIG. 7A illustrates a plan view of the label 200. As shown in FIG. 7A, the label 200 comprises a base sheet 205 having a top release layer 412, a top adhesive 255, and a top sheet 432 on a top surface thereof, and an bottom adhesive 250, a bottom release layer 410 and a bottom sheet 430 on a bottom surface thereof. In this embodiment all of the top sheet 432, the base sheet 205, and the bottom sheet 430 comprise thermally sensitive media having a thermally sensitive coating on a single side thereof. Other embodiments, including embodiments wherein one or more the top sheet 432, the base sheet 205 and the bottom sheet 430 comprise dual-sided thermal media having a thermally sensitive coating on two sides thereof, are, however, possible.

In the embodiment of FIGS. 7A, 7B and 7C the base sheet 205 comprises a cellulose (e.g., paper) substrate having a thermally sensitive coating on the front (top) side thereof. Different embodiments comprising different base sheet 205 substrates and/or coatings (e.g., a polymer sheet such as a spunbonded olefin having a thermally sensitive coating on both sides) are, however, possible.

As further illustrated in FIGS. 7A and 7B, the front side of the base sheet 205 comprises a section 210 upon which information may be printed, including thermally printed. Likewise, the front side of the top sheet 432 comprises a section 220 upon which information may be printed, including thermally printed. The top sheet 432 is removably attached to the base sheet 205 via the top adhesive 255, such as a hot melt glue or a pressure sensitive adhesive, and top release layer 412, such as a UV or EB cured silicone. Upon removal, the top sheet 432 may be permanently or removably affixed to an object, such as a document, via the top adhesive 255 which is removed with the top sheet 432, leaving the top release layer 412 on the base sheet 205.

As illustrated in FIGS. 7A and 7C, the back side of the bottom sheet 430 comprises a section 230 and a section 240 upon which information may also be printed, including thermally printed. The bottom sheet 430 is removably attached to the back side of the base sheet 205 via a bottom adhesive 250, such as a hot melt glue or a pressure sensitive adhesive, and a release coating 410, such as a UV or EB cured silicone. The bottom release layer 410 is removed with the bottom sheet 430 leaving the bottom adhesive 250 for adhering the base sheet 205 to an object such as a pharmaceutical or other container.

In the embodiment of FIGS. 7A, 7B and 7C, the imaginary line 215 separating the sections 210 and 220, and 230 and 240 is located such that the portion of the base sheet 205 proximate to the section 230 of the bottom sheet will substantially wrap around the circumference or perimeter of an object, such as a container, to which the base sheet 205 is attached. The portion of the base sheet 205 corresponding to the section 220 and proximate to the section 240 of the bottom sheet 430 will, then, substantially extend beyond and/or wrap around the attached portion. Upon removal of the top sheet 432 and associated top adhesive 255, this portion of the base sheet 205 will be removably adherable to the top surface of the base sheet 205 via the associated portion of the bottom adhesive 250 and the top release layer 412.

Owing to the thermally sensitive coatings thereon, variable information may be thermally printed on the sections 210, 220, 230 and 240 of the label 200 using a single or a two-sided thermal printer such as the printer 10 illustrated in FIG. 1. As previously described, such information may include information relating to an object such as a product with which some or all of the label 200 is associated or attached. Likewise, as previously described, such information may include transaction information such as item, quantity, store, date, time, price, tax and payment information. In one such embodiment, the base sheet 205 of the label 200 may be attached to an object, such as a pharmaceutical container, wherein information relating to the pharmaceutical is printed on the section 210, and information relating to the purchase thereof is printed on the sections 230 and 240 such that, when removed, the bottom sheet 430 becomes a receipt for the purchase transaction. In such embodiment, the top sheet 432 may comprise additional product such as a pharmaceutical information for adhering to a signature line of a record book at a pharmaceutical counter, and the like. Alternatively or additionally, the top sheet 432 may comprise additional information for adhering to a separate portion of a product, such as a top of a container, including warning information and administering information, and the like. Advertisements, coupons, rebates, or other promotional information may also be printed on the sections 230 and 240 of the bottom sheet 430 such that it may be separately handled and/or redeemed.

Using two-sided thermal labels it is possible to thermally print desired information on both sides of a label. Such label may then further be attached to a product or container for provision of related information. Depending on the design of and/or application for the label, one or more adhesives, such as hot melt adhesives, pressure sensitive adhesives and the like, and/or release layers, such as UV cured silicone, may be used. Likewise, one or more printable portions of a label may be removable for separate storage, use, redemption and the like.

As previously described, portions of thermal media having a release layer such as silicone may be thermally imaged through such release layer. Likewise, in an embodiment that uses an adhesive to attach a label to a container, a thermal image on the adhesive side may be restricted to the non-adhesive areas, or be printed prior to application of the adhesive. Additionally, depending on the embodiment one-sided and/or two-sided thermal papers may be used for some or all of a label. Further, various embodiments may be implemented using rolls, fanfold, or sheeted labels and/or form-label combinations. Form-label combinations are dominant in the pharmacy market today.

It should be noted that the embodiments illustrated in the figures are provided for example only, and not by way of restriction. Variations in the relative and absolute lengths, thicknesses, sizes and areas of a label, or portion thereof, as illustrated in any of the figures may, thus, be made.

The above description is illustrative, and not restrictive. Many other embodiments will be apparent to those of skill in the art upon reviewing the above description. The scope of the embodiments should therefore be determined with reference to the appended claims, along with the full scope of equivalents to which such claims are entitled.

The Abstract is provided to comply with 37 C.F.R. §1.72(b) and will allow the reader to quickly ascertain the nature and gist of the technical disclosure. It is submitted with the understanding that it will not be used to interpret or limit the scope of meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

We claim:

1. An image element, comprising:

a first substrate having a first and a second side; and a second substrate having a first and a second side, wherein the first substrate includes a thermally sensitive coating on at least the first side of the first substrate and the second substrate includes a thermally sensitive coating on at least the second side of the second substrate, and wherein the first side of the second substrate is releasably attached to the second side of the first substrate, and wherein the surface area of the second side of the first substrate is greater than the surface area of the first side of the second substrate.

2. The image element of claim 1, wherein the first substrate includes a thermally sensitive coating on the second side of the first substrate.

3. The image element of claim 1, wherein the first substrate includes a first adhesive on at least a first portion of the second side of the first substrate, and the second substrate includes a first release agent on at least a first portion of the first side of the second substrate proximate to the first adhesive.

4. The image element of claim 3, wherein the first substrate further includes a second adhesive on at least a second portion of the second side of the first substrate, and the second substrate includes a second release agent on at least a second portion of the first side of the second substrate proximate to the second adhesive.

5. The image element of claim 4, wherein the first substrate further includes a third release agent on at least a first portion of the first side of the first substrate.

6. The image element of claim 3, wherein the first substrate includes printed information beneath the first adhesive.

7. The image element of claim 1, further comprising:

a first adhesive fixably adhering at least a first portion of the second side of the first substrate to a first portion of the first side of the second substrate; and a die cut penetrating through a closed portion of the first portion of the second side of the first substrate such that the die cut portion of the first substrate is removable with the second substrate.

8. The image element of claim 1, wherein the first substrate further comprises a perforation such that a first portion of the first substrate is removable from the first substrate.

* * * * *